US010774517B2

(12) United States Patent
Chromey et al.

(10) Patent No.: US 10,774,517 B2
(45) Date of Patent: Sep. 15, 2020

(54) TRENCH DRAIN

(71) Applicant: Jay R. Smith Mfg. Co., Montgomery, AL (US)

(72) Inventors: Steven Chromey, Montgomery, AL (US); Mario L. Stan, Montgomery, AL (US); Donald E. Priester, Deatsville, AL (US)

(73) Assignee: Smith Industries, Inc., Montgomery, AL (US)

( * ) Notice: Subject to any disclaimer, the term of this patent is extended or adjusted under 35 U.S.C. 154(b) by 5 days.

(21) Appl. No.: 16/032,582

(22) Filed: Jul. 11, 2018

(65) Prior Publication Data

US 2018/0320357 A1 Nov. 8, 2018

Related U.S. Application Data

(63) Continuation of application No. 14/545,092, filed on Mar. 24, 2015, now Pat. No. 10,047,512.

(60) Provisional application No. 61/995,888, filed on Apr. 23, 2014.

(51) Int. Cl.

| | |
|---|---|
| ***E03F 1/00*** | (2006.01) |
| ***E02B 5/08*** | (2006.01) |
| ***E02B 13/00*** | (2006.01) |
| ***E02B 11/00*** | (2006.01) |
| ***E03F 3/04*** | (2006.01) |
| ***E03F 5/04*** | (2006.01) |

(52) U.S. Cl.
CPC ..... *E03F 3/046* (2013.01); *E03F 2005/0413* (2013.01)

(58) Field of Classification Search
CPC ..... E03F 3/046; E03F 2005/0413
See application file for complete search history.

(56) References Cited

U.S. PATENT DOCUMENTS

| | | | | |
|---|---|---|---|---|
| 2,170,671 | A | 8/1939 | Adler | |
| 4,498,807 | A * | 2/1985 | Kirkpatrick et al. | E01C 11/227 405/43 |
| 4,878,782 | A | 11/1989 | Beattie et al. | |
| 5,226,748 | A | 7/1993 | Barenwald et al. | |
| 5,340,234 | A | 8/1994 | Rossi et al. | |
| 5,372,457 | A | 12/1994 | Rante | |
| 5,522,675 | A | 6/1996 | Gunter | |
| 5,529,436 | A * | 6/1996 | Meyers | E01C 11/227 404/4 |
| 5,538,361 | A | 7/1996 | Beamer | |
| 5,718,537 | A * | 2/1998 | Becker | E01C 11/227 404/2 |
| 6,113,311 | A | 9/2000 | Becker et al. | |
| 6,192,181 | B1 * | 2/2001 | Haataja | G02B 6/4459 385/134 |
| 6,698,975 | B1 | 3/2004 | Benecke | |
| 6,860,678 | B2 * | 3/2005 | Gunter | E03F 3/046 405/118 |
| 6,908,256 | B1 | 6/2005 | Humphries et al. | |

(Continued)

*Primary Examiner* — Tara Mayo-Pinnock
(74) *Attorney, Agent, or Firm* — Eric J. Sosenko; Jonathan P. O'Brien; Honigman LLP

(57) ABSTRACT

A trench drain defining a channel and having an accessory rib allowing the convenient attachment of accessories to the sides of a drain in order to facilitate the installation of a trench drain, place drain outlets at any convenient places along the trench drain, and to create right angle joints between two trench drains.

12 Claims, 8 Drawing Sheets

(56) References Cited

U.S. PATENT DOCUMENTS

| | | | |
|---|---|---|---|
| 7,534,071 | B2 | 5/2009 | Humphries et al. |
| 8,475,079 | B2 | 7/2013 | Humphries et al. |
| 2010/0276566 | A1 | 11/2010 | Pankan |

* cited by examiner

TRENCH DRAIN

CROSS-REFERENCE TO RELATED APPLICATIONS

This application is a continuation of U.S. application Ser. No. 14/545,092 filed Mar. 24, 2015, which is a non-provisional application claiming the benefit of U.S. application Ser. No. 61/995,888 filed Apr. 23, 2014, the disclosures of which are herein incorporated by reference in their entirety.

BACKGROUND

1. Field of the Invention

Embodiments of this invention relate to the flow of fluid in an open channel or flume.

In particular, embodiments relate to the flow of water through floor trench drains which have a grated upper surface and which drain into a catch basin and thereafter into a drain for disposal. Embodiments include sloping interlocking channels with a small slope in the bottom from one end to the other to direct the flow of water or neutral unsloped channels which may be interspersed between sloping channels. A catch basin at the end of the drain receives the flow.

Embodiments are designed to drain impermeable surfaces such as parking lots, or factory floors, or domestic patios. Channels are surrounded on all sides by the impermeable material such as concrete or asphalt except the top which has a removable grate permeable to water. It is important in the installation of trench drains that the channels be installed level at a predetermined height above the subsurface in order to insure the grate at the top of the channel is level and flush with the poured concrete or asphalt.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

In one aspect of the invention, a U-shaped trench drain channel is provided. The drain channel includes a body having two side walls and a bottom wall connecting the two side walls. The bottom wall defines an upper surface located within the drain channel and an appliance rib is provided on each side of the drain channel at a location between a top end of each of the side walls and the upper surface of the bottom wall. The appliance ribs extend substantially the length of the drain channel and are configured to retain appliances at any site along the length thereof.

In another aspect of the invention, an appliance attached to the appliance ribs, the appliance being one of a channel chair, an outlet hub adaptor and a tee connector.

In a further aspect of the invention, the appliance ribs include an upper surface extending laterally outward from the side walls.

In an additional aspect of the invention, the appliance ribs include an upper surface extending orthogonally outward from the side walls.

In still another aspect of the invention, the drain channel is a male connector trough.

In yet a further aspect of the invention, one end of the drain channel includes a male connector with a pin extending therefrom and the other end of the drain channel includes a female connector with an aperture formed therein.

In another aspect of the invention, a trench drain system is provided. The system includes a plurality of interlocked channels, with each channel being generally U-shaped in cross-section and having an elongated length with a male connector on one end and a female connector on another end. Each channel also has a bottom wall with an upper surface and two upright side walls extending upward from the bottom wall. Each channel also including at least two U-shaped reinforcing ribs disposed along the length of the channel and extending over the upright side walls and the bottom wall. An accessory rib is attached to each side wall between a top end of each side wall and the upper surface of the bottom wall with the accessory rib extending longitudinally along each side wall between the reinforcing ribs.

In another aspect of the invention, an accessory attached to the accessory ribs.

In a further aspect of the invention, the accessory is one of a channel chair, an outlet hub adaptor and a tee connector.

In yet another aspect of the invention, the appliance ribs include an upper surface extending laterally outward from the side walls In an additional aspect of the invention, the appliance ribs include an upper surface extending orthogonally outward from the side walls.

In still a further aspect of the invention, one end of the drain channel includes a male connector with a pin extending therefrom, and the other end of the drain channel includes a female connector with an aperture formed therein.

In another aspect, the invention provides a trench drain. The trench drain includes an elongated body having opposed side walls and a bottom wall connecting the side walls. The bottom wall has an upper surface and the side walls have inner surfaces that cooperating to define a U-shaped channel within the body. An appliance rib is provided on each side of the body and extends substantially the length of the body. The appliance ribs are located between a top end of each of the side walls and the upper surface of the bottom wall. The appliance ribs is configured to retain appliances on the body at any position along the length thereof.

In another aspect of the invention, the appliance ribs project laterally outward from the side walls.

In a further aspect of the invention, the appliance ribs include an upper surface extending laterally outward from the side walls.

In an additional aspect of the invention, the appliance ribs include an upper surface extending orthogonally outward from the side walls.

In yet a further aspect of the invention, the side walls are parallel to one another.

In still an additional aspect of the invention, an appliance is suspended from the appliance ribs.

In still another aspect of the invention, the appliance is one of a channel chair, outlet hub adapter and tee connector.

In a further aspect of the invention, a plurality of the elongated bodies in interlocking engagement with one another.

In an additional aspect of the invention, one end of the elongated bodies includes a male connector with a pin extending therefrom, and the other end of the elongated bodies includes a female connector with an aperture formed therein.

In addition to the exemplary aspects and embodiments described above, further aspects and embodiments will become apparent by reference to the drawings and by study of the following descriptions.

DETAILED DESCRIPTION OF THE INVENTION

Figure 1:
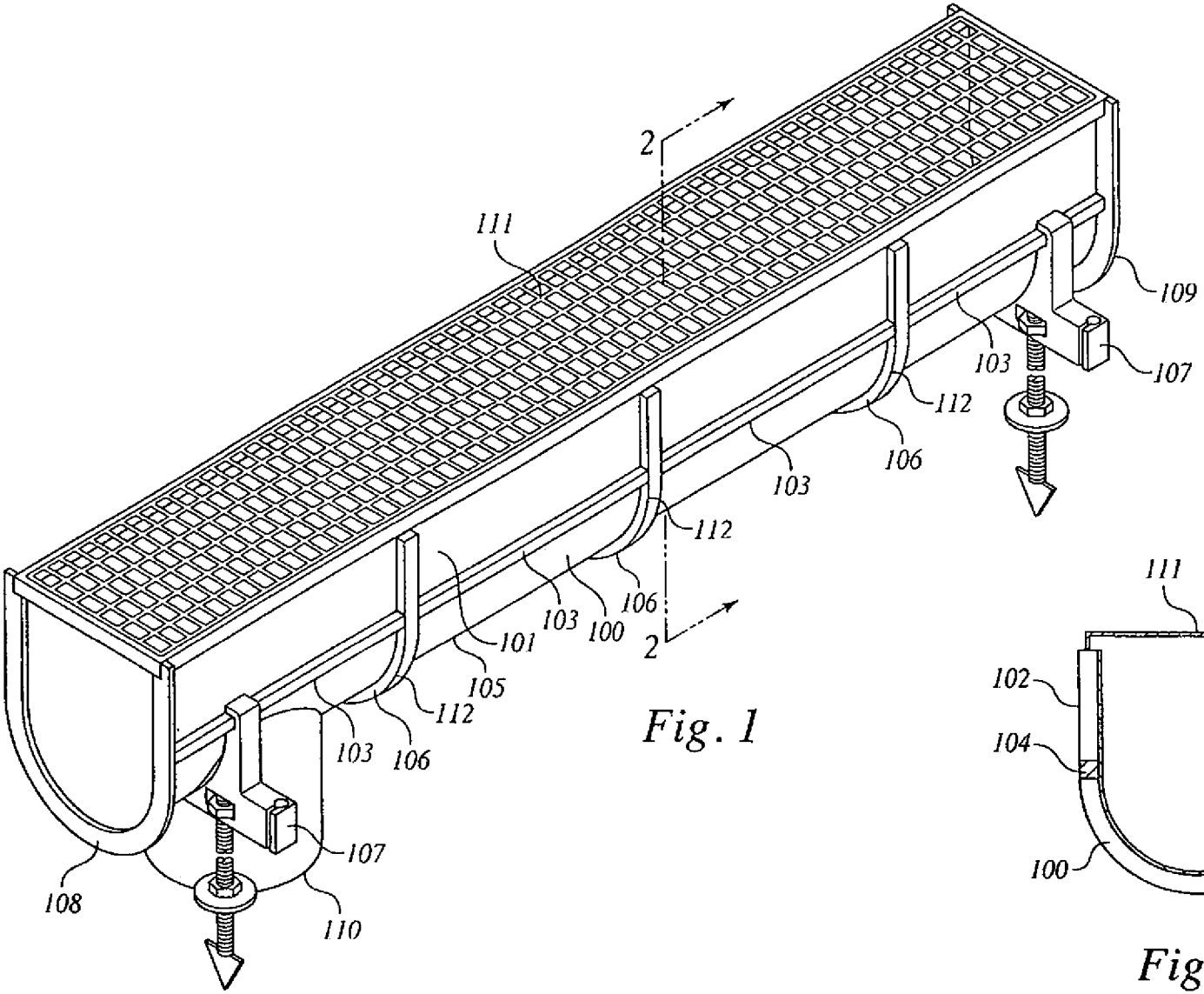
FIG. 1 is a perspective view of an embodiment sloping channel.

FIG. 1 is a perspective view of an embodiment sloping channel 100. The channel slopes from the shallow end where the female-connector 109 is located to the deep end where the male-connector 108 is located. A normally closed no-hub vertical outlet 110 is located near the male-connector 108. This outlet may be opened by cutting through the bottom with a saw or drill which makes a circular hole. Channels are connected to each other by tongue and groove connectors 108 and 109, respectively. Details of the connections are in FIGS. 3 and 4. Visible in FIG. 1 is the right wall 101, right appliance rib 103 which runs along the wall from one end of the channel to the other between ribs 106. Ribs 106 have a center groove 112. Channels may be reduced in length by cutting with a saw through the groove 112 or at any other portion of the channel. In embodiments, the ribs are located ¼ m apart. When a cut is made through the center groove 112 of a rib 106 the result is two shorter channels, one with a male and a female end, the other with two male ends. Such male ends, like all male ends, can be inserted into the female end of another channel in order to connect the channels, the channel can be terminated using an end plate attached to the male end, or the cut channel male end can be joined to another channel male end using a U-shaped coupling (see FIG. 13). Rebar clips 107 are located at each end of the channel on each side. Lengths of rebar may secured in the clips to support the channel before the concrete or asphalt is poured. A grate 111 is fitted into the open top of the channel after the channel is installed and the concrete or asphalt has hardened. An insert board (not shown in FIG. 1) of the same dimensions as the grate is used to cover the channel during installation to prevent entry of concrete, asphalt, or debris during installation.

Figure 2:
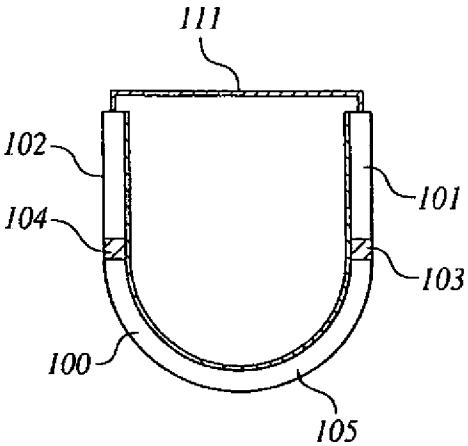
FIG. 2 is a cross section of the embodiment sloping channel of FIG. 1 taken at arrows 2-2.

FIG. 2 is a cross section of the embodiment sloping channel of FIG. 1 taken at arrows 2-2. Visible in FIG. 2 is the bottom 105, right wall 101, left wall 102, right appliance rib 103, left appliance rib 104, and grate 111.

Figure 3:
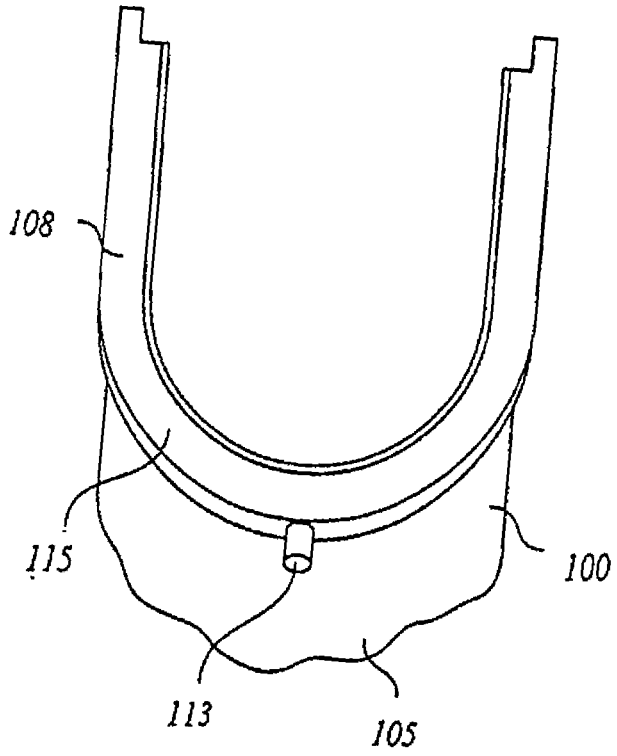
FIG. 3 is a perspective view of an embodiment channel male end.

FIG. 3 is a perspective view of the bottom 105 of an embodiment channel 100 showing the male end 108. FIG. 3 shows the horseshoe-shaped male connector flange or rib 113. A pin 113 protrudes from the center of the flange 115.

Figure 4:
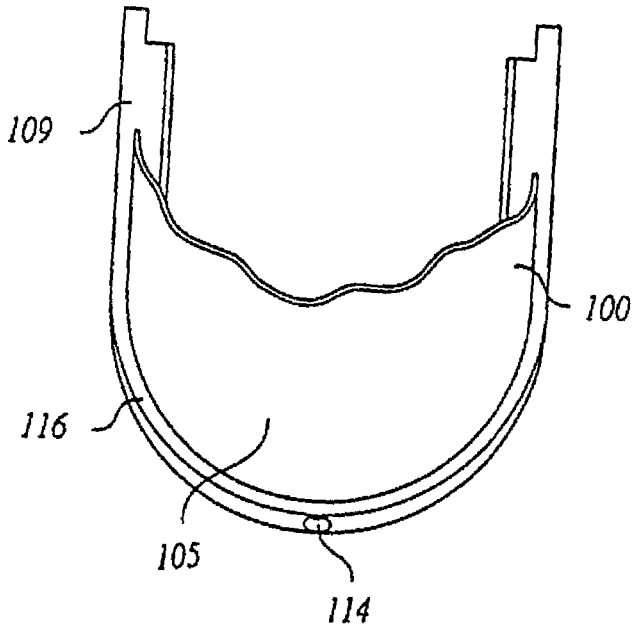
FIG. 4 is a perspective view of an embodiment channel female end.

FIG. 4 is a perspective view of the bottom 105 of an embodiment channel 100 showing the female end 109. FIG. 4 shows the horseshoe-shaped female connector trough or sleeve 116 which is U-shaped in cross-section. A female connector aperture 114 is located at the center of the trough 116.

Adjacent channels are connected by inserting the male connector flange or rib (113 in FIG. 3) into the female connector trough or sleeve (116 in FIG. 4) The male connector pin (113 in FIG. 3) protrudes through the female connector aperture (116 in FIG. 4) when two channels are connected. The pin/aperture arrangement insures a stable connection between the two channels and prevents rotation of one channel with respect to the adjacent connected channel.

Figure 5:
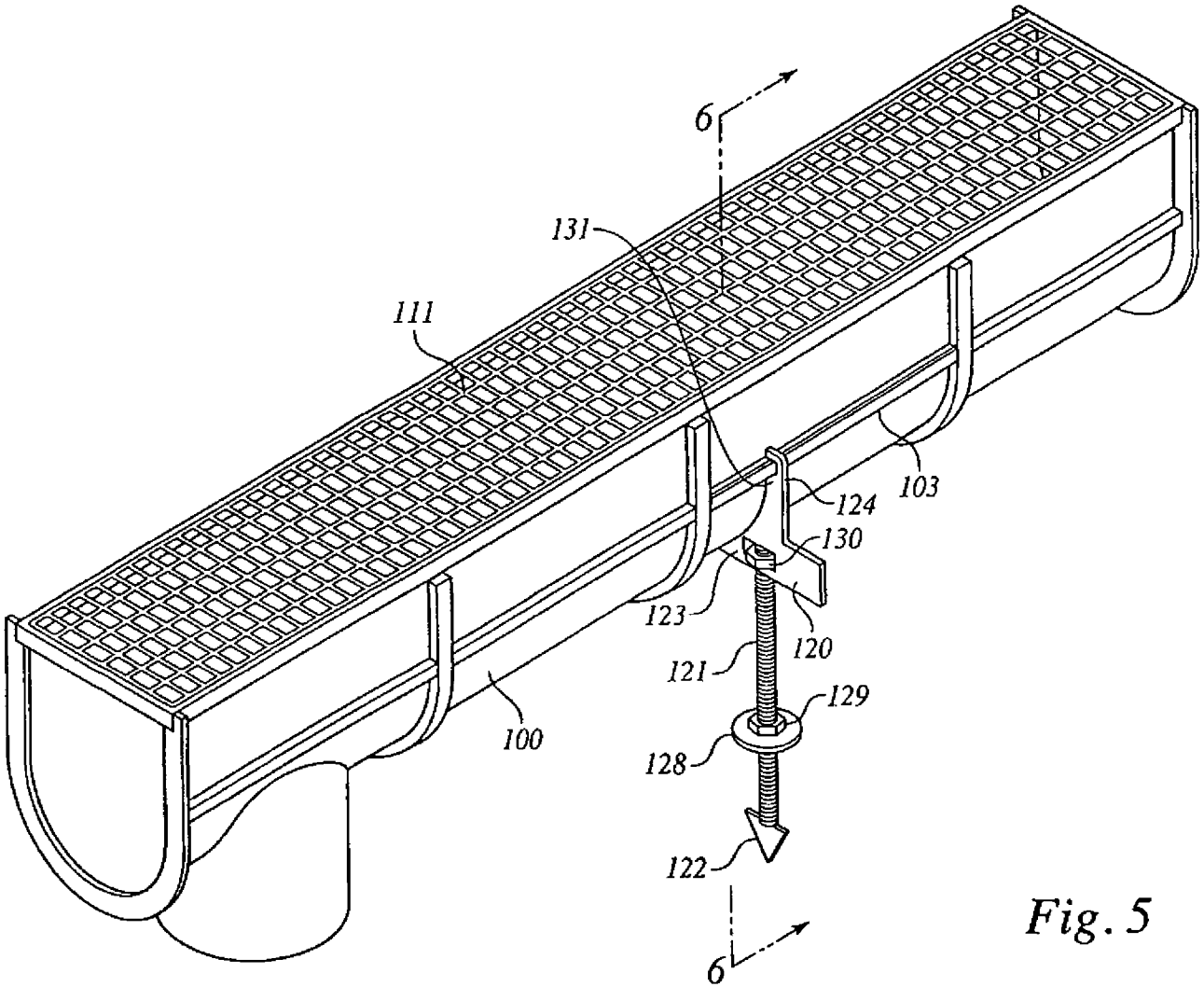
FIG. 5 is a perspective view of an embodiment sloping channel with an attached upright elongated anchor.

FIG. 5 is a perspective view of an embodiment sloping channel 100 and grate 111 with an attached channel chair 120. The channel elements of FIG. 5 are the same as in FIG. 1. A channel chair comprises a threaded rod 121 with a foot 128 and a nut 129 and an arrowhead 122 on one end and a mount 123 with two ears, right side front ear 131 and right side rear ear 124. The ears attach to the right appliance rail 103 on the channel. An adjusting nut 130 allows fine adjustment of the height of the mount 123. The nut 129 and foot 128 are used to stabilize the threaded rod in the ground.

Optionally, rebar may be used to stabilize the chair in the trench with or without use of the threaded rod 121. Visible in FIG. 5 is a right rebar clip 138 comprised of a right cylindrical hole 134 and a right slot 132. In use, rebar is inserted into the hole and secured by drawing the slot against the chair body using fasteners (not shown in FIG. 5).

The channel chair is installed by driving the threaded rod into the ground below the planned trench drain route and rotating the threaded rod to anchor the arrowhead in the ground. The foot is pressed against the ground using the adjusting nut. Alternatively, the channel chair may be supported by two rebar members attached to the ends of the channel chair by rebar clips. The mount is attached to appliance rails on each side of the channel via the ears. One channel chair is used for each channel.

Figure 6:
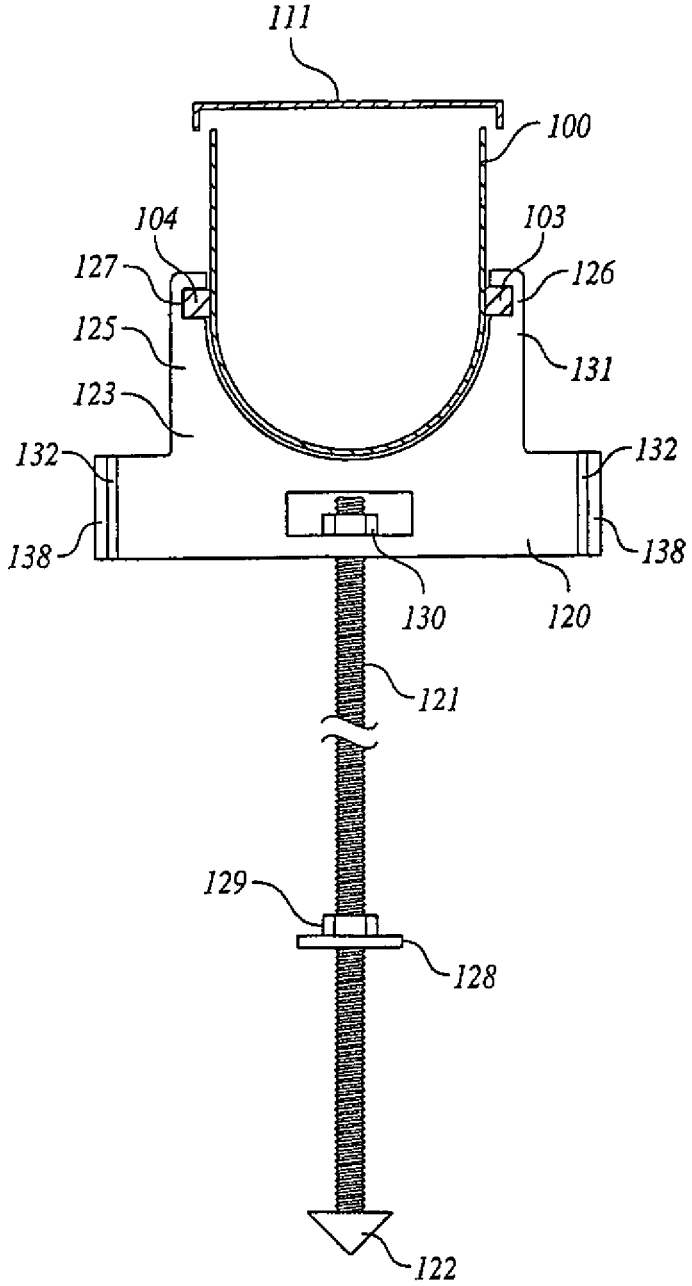
FIG. 6 is a cross section of the embodiment sloping channel with an attached upright elongated anchor of FIG. 5 taken at arrows 6-6.

FIG. 6 is a cross section of the embodiment sloping channel 100 and grate 111 with an attached upright elongated anchor of FIG. 5 taken at arrows 6-6. The channel elements of FIG. 6 are the same as in FIG. 2. Visible in FIG. 4 is the channel chair 120 with threaded rod 121, foot 128, foot adjusting nut 129, arrowhead 122 and mount adjusting nut 130 and left side rear ear 125 with left side rear ear notch 127 attached to mount 123 along with right side front ear 131 and right side front ear notch 126. The mount is attached to the channel via the left side rear ear 125 and left side rear ear notch 127 which interacts with and attaches to the left appliance rib 104 and the right side front ear 131 and right side front ear notch 126 which interacts with and attaches to the right appliance rib 103. Also visible in FIG. 6 are the slots 132 of the rebar clips 138.

The use of a channel chair allows installation of a trench drain by a single worker. In addition, the channel chair anchors the channel and prevents the possibility of floating of the trench drain in the wet concrete or asphalt.

A suitable channel chair can be obtained from Jay R. Smith Mfg. Co., Montgomery, Ala., where it is sold as a Rante-arrow channel chair accessory.

Figure 7:
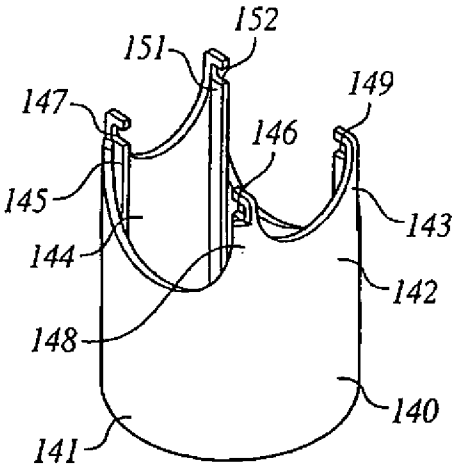
FIG. 7 is a perspective view of an embodiment outlet hub adaptor.

FIG. 7 is a perspective view of an embodiment outlet hub adaptor 140. A hub adaptor allows the addition of an outlet to a channel at any site on the channel by cutting a hole in the bottom of the channel and attaching a hub adaptor. Visible in FIG. 7 is a cylinder 141 which is attached to a right web 142 and to a left web 144. Attached to the right web 142 are a right web left ear 148 with a right web left ear notch 146 and a right web right ear 143 with a right web right ear notch 149. Attached to the left web 144 are a left web left ear 151 with a left web left ear notch 152 and a left web right ear 145 with a left web right ear notch 147.

Figure 8:
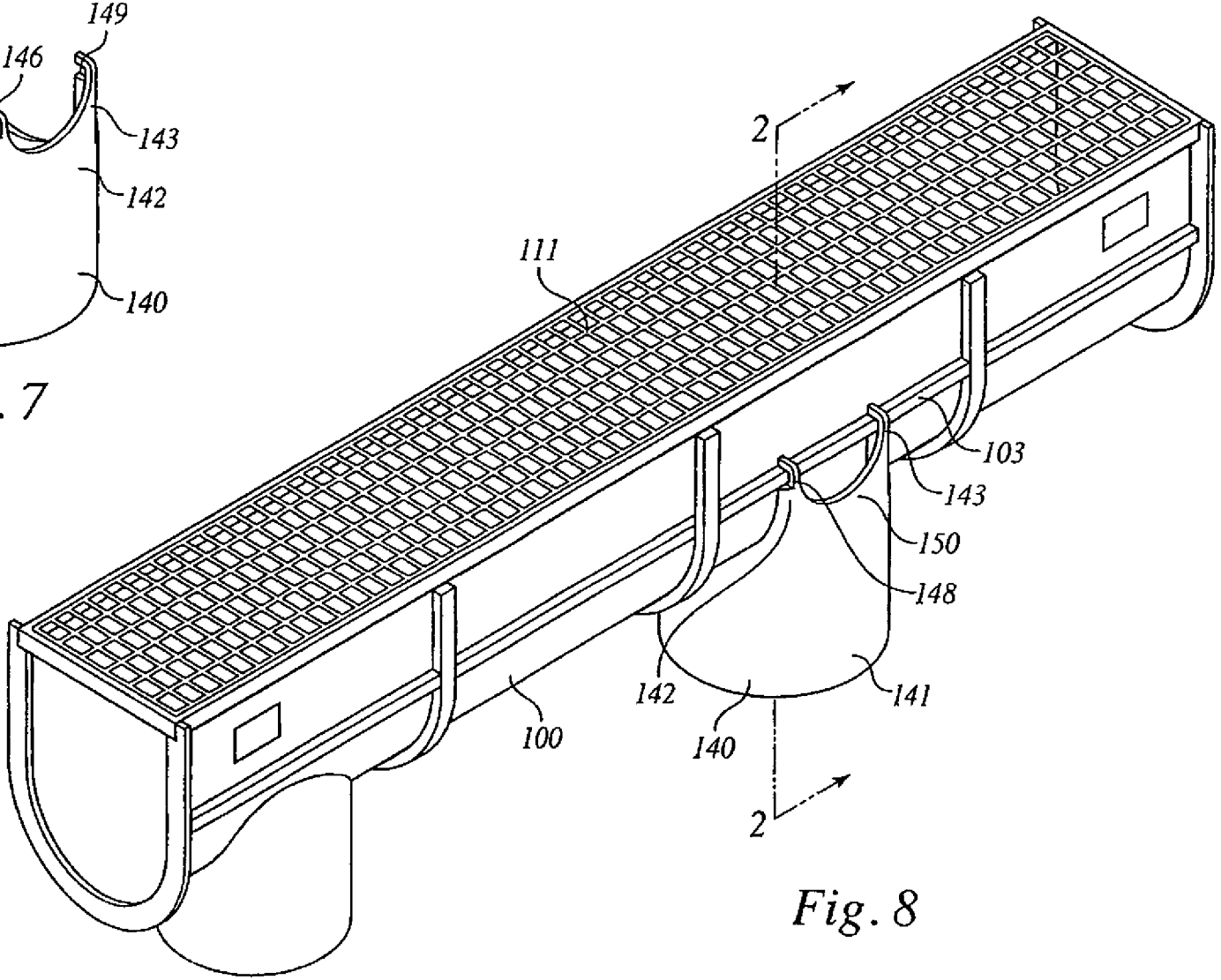
FIG. 8 is a perspective view of an embodiment sloping channel with an outlet hub adaptor attached.

FIG. 8 is a perspective view of an embodiment sloping channel 100 and grate 111 with an outlet hub adaptor 140 attached. The channel elements of FIG. 8 are the same as in FIG. 1. Also visible in FIG. 8 is the hub adaptor 140 with cylinder 141, right web 142, right web right ear 143, right web left ear 148 and right appliance rib 103.

Figure 9:
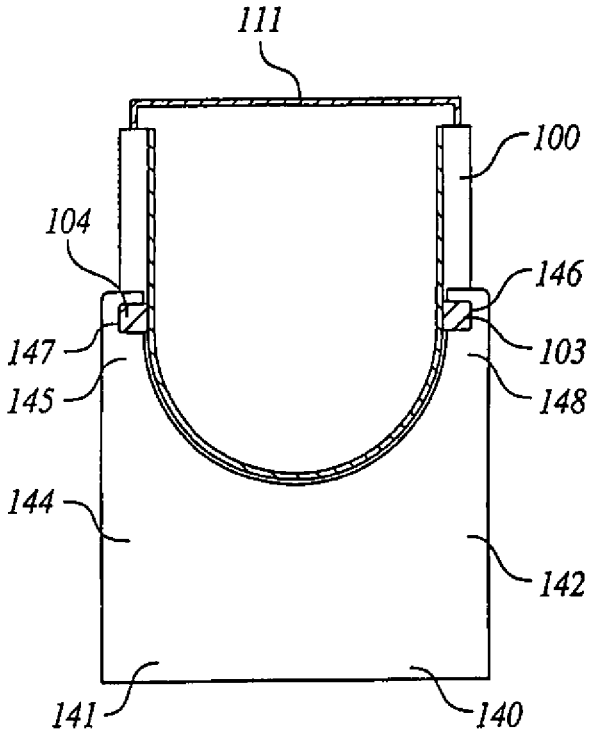
FIG. 9 is a cross section of the embodiment sloping channel with an outlet hub adaptor attached of FIG. 8 taken at arrows 9-9.

FIG. 9 is a cross section of the embodiment sloping channel 100 and grate 111 with an outlet hub adaptor attached of FIG. 8 taken at arrows 9-9. The channel elements of FIG. 9 are the same as in FIG. 2. Visible in FIG. 9 is the outlet hub 140 with cylinder 141, right web 142, right web left ear 148 and right web left ear notch 146. Also visible is the left web 144, left web right ear 145 and left web right ear notch 147. The left web right ear 145 is attached to the left appliance rib 104 by the left web right ear notch 147. The right web left ear 148 is attached to the right appliance rib 103 by the right web left ear notch 146.

Figure 10:
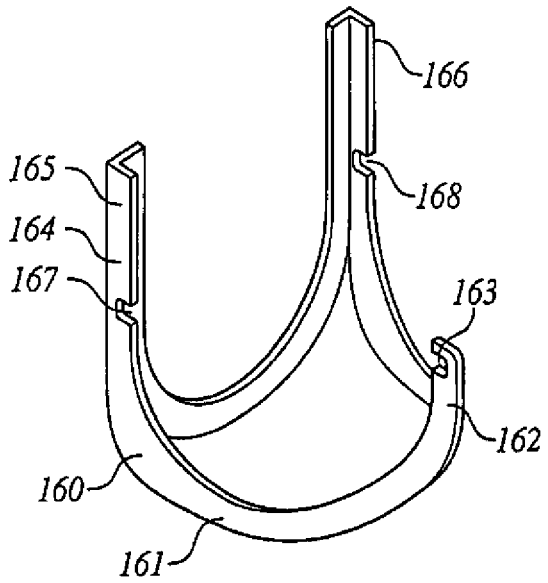
FIG. 10 is a perspective view of an embodiment tee connector.

FIG. 10 is a perspective view of an embodiment tee connector 160. A tee connector is used to provide a female connector on the side of a channel in order to attach another channel. A hole is cut in the side of a channel and the tee connector is attached. Visible in FIG. 10 is a tee connector 160 which comprises a web 161 with on one side an attached ear 162 with ear notch 163. On the other side of the web a female connector 164 is connected. The female connector comprises a left arm 166 with a notch 168 and a right arm 165 with a notch 167.

Figure 11:
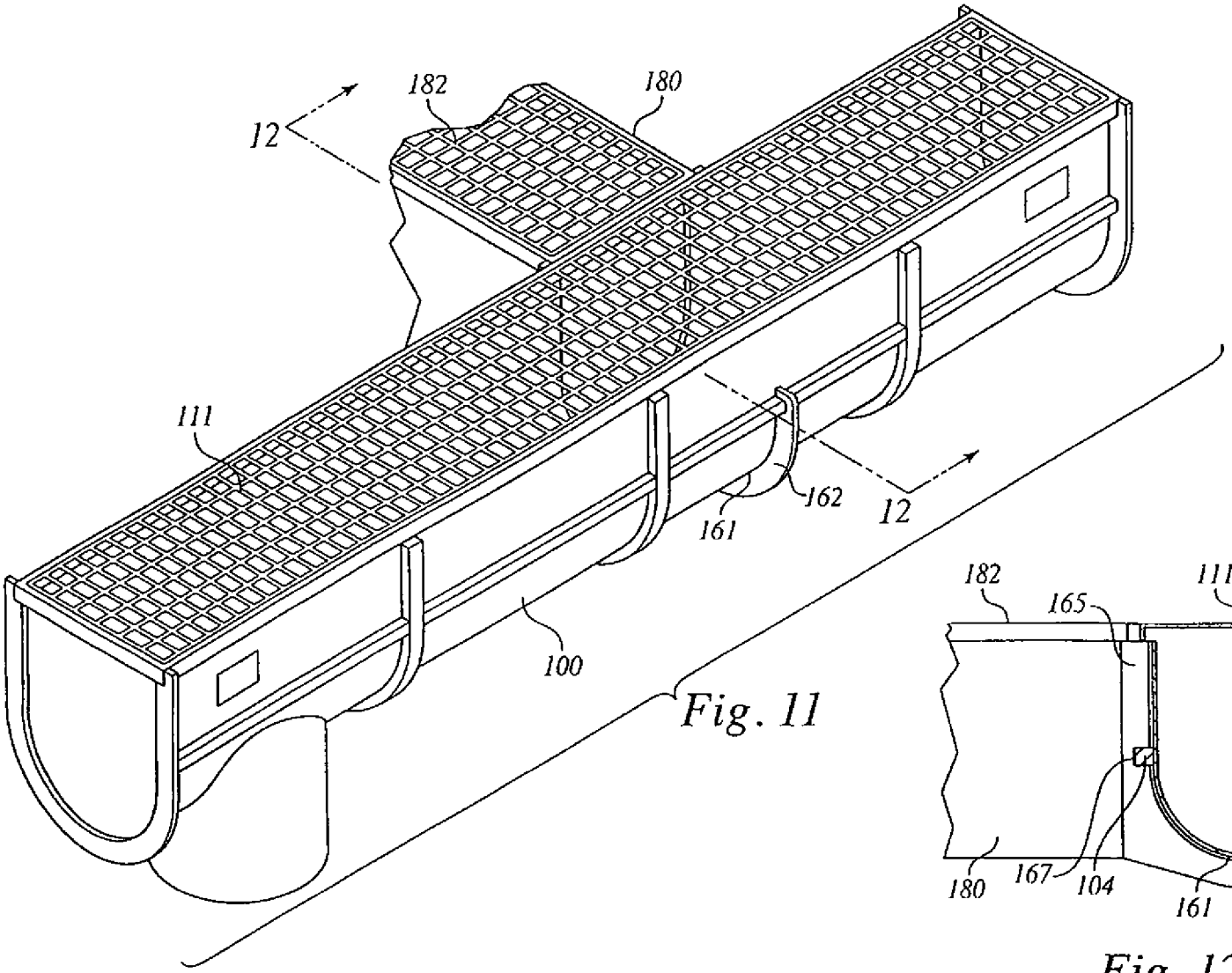
FIG. 11 is a perspective view of an embodiment sloping channel with a tee channel attached by a tee connector.

FIG. 11 is a perspective view of an embodiment sloping channel 100 and grate 111 with a channel attached by a tee connector. The channel elements of FIG. 11 are the same as in FIG. 1. Visible in FIG. 11 is the attached channel 180 with grate 182. Also visible in FIG. 11 is the tee adaptor web 161 and tee adaptor ear 162.

Figure 12:
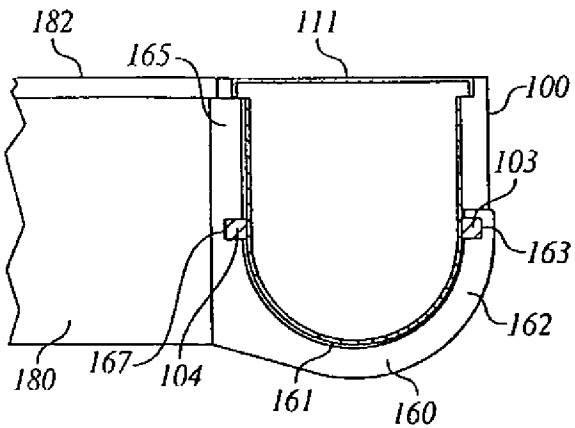
FIG. 12 is a cross section of the embodiment sloping channel with a tee channel attached by a tee connector of FIG. 11 taken at arrows 12-12.

FIG. 12 is a cross section of the embodiment sloping channel 100 and grate 111 with a channel attached by a tee connector of FIG. 11 taken at arrows 12-12. The channel elements of FIG. 12 are the same as in FIG. 2. Visible in FIG. 12 is the connected channel 180 and its grate 182. Also visible in FIG. 12 is the tee connector 160 with web 161, ear 162, ear notch 163, and female connector left arm 165 with notch 167. The ear notch 163 interacts with and is connected to the right appliance rib 103 on the channel and the female connector left arm notch 167 and right arm notch 168 (not visible in FIG. 10) interact with and are attached to the left appliance rib 104 on the channel.

Figure 13:
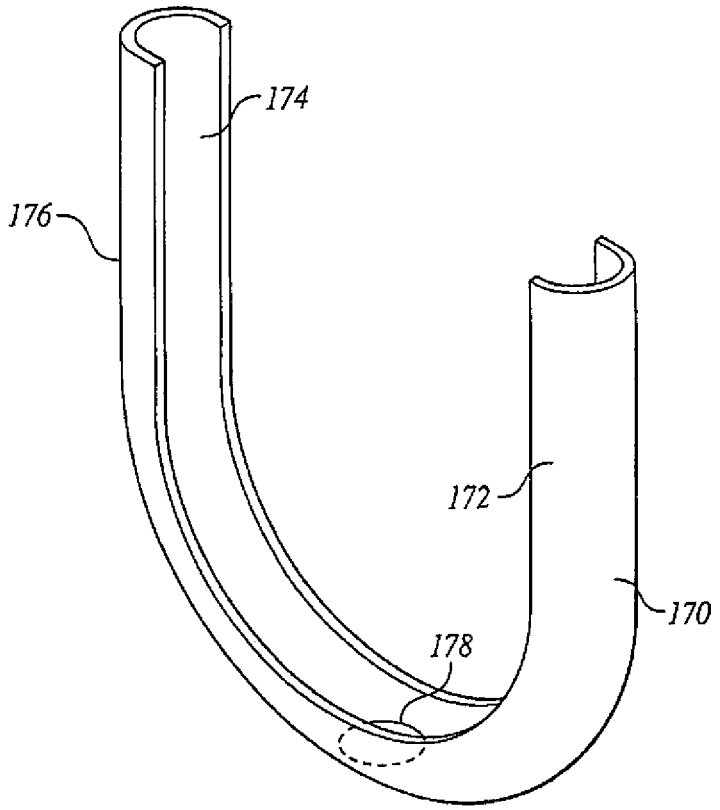
FIG. 13 is a perspective view of an embodiment male connector.

FIG. 13 is a perspective view of an embodiment male connector trough 170. The male connector is generally horseshoe shaped with a U-shaped cross-section. Visible in FIG. 13 is the front side 172, back side 174 and web 176 which connects the front and back sides. The web 176 is wide enough to accommodate two adjacent male connector flanges or ribs. The web 176 has an aperture 178 in the center of the male connector trough. The aperture 178 interacts with pins on male connector flanges or ribs and prevents rotation of one connected channel with respect to the adjacent connected channel. The male connector can be used to place two male channel ends back to back to extend the length of a given run. It is also required in some instances if a channel section is shortened by 0.25 m or more.

Embodiments channels are 1 meter in length with an internal width between walls of 95 mm. In embodiments, the slope of the bottom of a sloped channel is 0.6%. In embodiments the heights of the walls of channels nearest to the drain basin are higher than those at the other end. In embodiments, the depth of the deep ends of channels varies from 111 mm to 260 mm. Embodiment trench drain systems using only slope channels extend some 20 m from a drain basin, while embodiment systems using interspersed sloped and level channels extend some 40 m from a drain basin.

Embodiment outlet hub adaptors have a cylinder of 102 mm diameter. Embodiment channels have a no-hub vertical outlet of 102 mm diameter.

Embodiment channels are manufactured of any impervious, durable, inexpensive material. Embodiment channels are manufactured of recycled polypropylene with U.V. inhibitors.

Embodiment grates are manufactured of any stable durable material strong enough to resist breakage in use. Embodiment grates are manufactured of polypropylene, vinylester fiberglass, composite resin, galvanized steel, ductile iron, and stainless steel. Embodiment grates have the surfaces which are perforated with small holes, slotted, cross-hatched, meshed, or with custom and decorative patterns, as dictated by the traffic which will cross the grate and the conditions of use. Embodiment grates are solid for use when the channels are used to contain pipes, wires or conduits rather than water.

Connections between channels and between channels and appliances such as a outlet hub adaptor and a tee connector are sealed with a suitable calk such as a polyurethane sealant.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

We claim:

1. A U-shaped trench drain channel comprising:

a body having two side walls and a bottom wall connecting the two side walls, the bottom wall having an upper surface located within the drain channel, an appliance rib provided on each side of the drain channel and located between a top end of each of the side walls and the bottom wall, the appliance ribs extending the length of the drain channel and configured to retain appliances at any site along the length thereof; and an appliance attached to both of the appliance ribs, the appliance being an outlet hub adapter, whereby an outlet can be added to the channel by cutting a hole in the bottom of the channel and attaching the hub adaptor outlet about the hole.

2. The drain channel of claim 1, wherein the appliance ribs include an upper surface extending laterally outward from the side walls.

3. The drain channel of claim 1, wherein the appliance ribs include an upper support surface extending orthogonally outward from the side walls.

4. The drain channel of claim 1, wherein the drain channel is a male connector trough.

5. The drain channel of claim 1, wherein one end of the drain channel includes a male connector with a pin extending therefrom, and the other end of the drain channel includes a female connector with an aperture formed therein.

6. A trench drain comprising:

an elongated body having opposed side walls and a bottom wall connecting the side walls, the bottom wall having an upper surface and the side wall having inner surfaces, the upper and inner surfaces cooperating to define a U-shaped channel within the body, an appliance rib provided on each side of the body and extending the length of the body, the appliance ribs being located between a top end of each of the side walls and the bottom wall, the appliance ribs being configured to retain appliances on the body at any position along the length thereof; and an appliance suspended from both of the appliance ribs, the appliance being a tee connector, whereby a connector can be added to the channel by cutting a hole in the side of the channel and attaching the tee connector about the hole.

7. The trench drain according to claim 6, wherein the appliance ribs project laterally outward from the side walls.

8. The trench drain according to claim 6, wherein the appliance ribs include an upper surface extending laterally outward from the side walls.

9. The trench drain according to claim 6, wherein the appliance ribs include an upper support surface extending orthogonally outward from the side walls.

10. The trench drain according to claim 9, wherein the side walls are parallel to one another.

11. The trench drain according to claim 6, further comprising a plurality of the elongated bodies in interlocking engagement with one another.

12. The trench drain according to claim 11, wherein one end of the elongated bodies includes a male connector with a pin extending therefrom, and the other end of the elongated bodies includes a female connector with an aperture formed therein.

* * * * *